United States Patent [19]

Obenchain

[11] 3,953,196

[45] Apr. 27, 1976

[54] PROCESS FOR THE DIRECT REDUCTION OF METAL OXIDES

[76] Inventor: Richard F. Obenchain, 3340 Comanche Road, Pittsburgh, Pa. 15234

[22] Filed: Apr. 5, 1974

[21] Appl. No.: 458,096

[52] U.S. Cl. ..... 75/38; 75/11; 75/80

[51] Int. Cl.[2] ..... C21B 13/14

[58] Field of Search ..... 75/33–38, 75/40, 11, 80

[56] References Cited

UNITED STATES PATENTS

| | | | |
|---|---|---|---|
| 3,301,661 | 1/1967 | McGlynn et al. | 75/40 |
| 3,313,618 | 4/1967 | Feinman et al. | 75/43 |
| 3,503,736 | 3/1970 | Sherwood | 75/40 |
| 3,634,064 | 1/1972 | Vedensky | 75/33 |
| 3,652,069 | 3/1972 | Worner | 75/40 |
| 3,746,533 | 7/1973 | Moussoulos | 75/40 |

*Primary Examiner*—M. J. Andrews
*Attorney, Agent, or Firm*—Parmelee, Miller, Welsh & Kratz

[57] ABSTRACT

Metal oxides are directly reduced by charging metal oxide-carbonaceous agglomerates to a shaft furnace, passing said pellets downwardly countercurrent to a flow of hot gases in a reduction zone, wherein the agglomerates are heated to 2000°–2400°F. and reduction effected while the agglomerates maintain their integrity, and then transferring the reduced pellets to a melting zone. In the melting zone, having a controlled atmosphere, the pellets melt and a mass of molten metal and slag is formed and then discharged from the melting zone.

12 Claims, 6 Drawing Figures

PROCESS FOR THE DIRECT REDUCTION OF METAL OXIDES

BACKGROUND OF THE INVENTION

It has been previously proposed to use a shaft furnace for the direct reduction of iron oxide. Such proposals, however, have generally used a countercurrent flow of highly reducing gases to effect reduction of the iron oxide with the reduction requiring a lengthy period of time because of the gas-solid contact required to effect the reduction.

I have found that by using an iron oxide pellet containing solid carbonaceous material wherein sufficient carbon is present therein to effect complete reduction of the iron oxide under controlled conditions, the iron oxide will be reduced and a molten iron core formed within a slag-type incrustation, which incrustation protects the core from oxidation even under oxidizing atmospheric conditions, until this shell itself is rendered molten.

BRIEF SUMMARY OF THE INVENTION

Metal oxides are directly reduced by charging agglomerates of metal oxide and a carbonaceous material to the preheating zone of a shaft furnace, passing the agglomerates downwardly to a reducing zone of the shaft furnace wherein the agglomerates are heated by countercurrent gases to an elevated temperature, at which temperature the reduction of the metal oxide is effected by the carbonaceous material, while the agglomerates maintain their integrity, said temperature being less than about 2400°F. for iron oxide. The hot agglomerates are then transferred to a melting vessel and highly heated with resultant liquifying of the metal and slag of the agglomerates. The molten metal so produced is released from the agglomerates under a controlled atmosphere so as to prevent undesired reoxidation of the metal previously formed at this stage of the process and the molten metal and resultant slag are then discharged from the melting vessel.

DETAILED DESCRIPTION

The present invention relates to a process for the production of metal, such as iron, from carbon-containing metal oxide agglomerates, such as carbon-containing iron ore pellets. The agglomerates are preheated and reduced in a shaft-type furnace and transferred at an elevated temperature of about 2000°–2400°F. to a melting vessel for melting of the agglomerates with release of molten metal to form a combination of molten metal and slag which are then discharged.

The agglomerates used as starting material are preferably pellets formed from a mixture of metal oxide and a carbonaceous material, optionally with a binder added. Natural ores, reclaimed metal oxide or other forms of metal oxide may be used, with the process especially adapted for the production of iron from iron oxides, using crushed iron ore, iron oxide fines and various iron oxide waste materials, such as blast furnace dust, open hearth dust, electric furnace dust, mill scale or the like. Other metal oxides, however, such as chrome concentrates, chrome oxides, chrome ore or manganese ores, may also be reduced according to the present process. The following description, for the purpose of brevity, relates to the production of iron from iron oxide.

The iron oxide material is intimately mixed with a carbonaceous material in formation of the agglomerates and may comprise coke, finely divided coal, petroleum coke, plant wastes such as coke breeze, or the like, which will effect reduction of the iron oxide. The amount of carbonaceous material added to the agglomerates is an amount sufficient to effect complete reduction of the iron oxide in the pellet, generally an amount corresponding to 5–30% by weight of the agglomerate.

The particle size of the iron oxide and the carbonaceous material, in order to assure intimate mixing and adequate solid-to-solid contact, should be such that at least about 50% of the particles pass through a 200-mesh screen while substantially all particles are such that they will pass through a 30-mesh screen. The more finely divided and more intimately mixed the iron oxide and carbonaceous material, the more efficient the reduction thereof. Steel plant wastes, such as BOF precipitator dust, because of their very fine particle size enhance reduction.

The slag forming materials are primarily oxides of aluminum and silicon and oxides of the alkali and alkaline metals. The source of the slag forming materials may be naturally occurring impurities in the iron oxides, as in the case of iron ore or blast furnace dust, or they may be deliberately added to the pellets. Slag forming material may also result from the ash residue from the carbonaceous material added.

Figure 1:
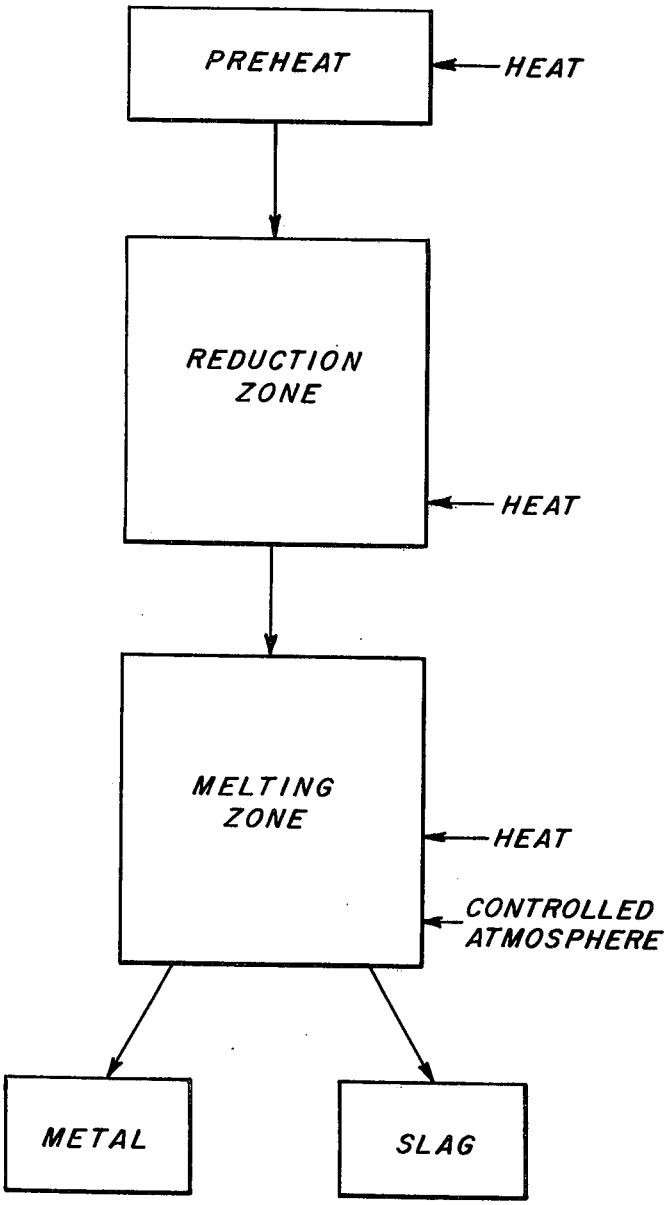
FIG. 1 is a flow chart illustrating the process of the present invention.

In FIG. 1, there is schematically illustrated a flow diagram of the process of the present invention. As therein shown, agglomerates of a metal oxide and carbonaceous material are charged to a preheating zone wherein the agglomerates are subjected to heat. The agglomerates then pass to a reduction zone where they are further heated, preferably by the passage therethrough of a hot countercurrent gaseous stream, with the agglomerates heated to a temperature of 2000°–2400°F. at the time of exit from the reducing zone to an adjacent melting zone. The agglomerates, at a temperature of 2000–2400°F., are then transferred to a melting zone wherein they are heated to temperatures in excess of 2400°F., at which temperature the agglomerates melt and release molten metal produced by the reduction of the metal oxide by the carbonaceous material in intimate contact therewith in the agglomerate. The molten metal, at the time of release from the agglomerate, must be protected from oxidation and, for this purpose, a controlled atmosphere is required at this stage of the process. After release of the molten metal, the metal and accompanying slag from the remaining components of the agglomerates are discharged from the system.

Figure 2:
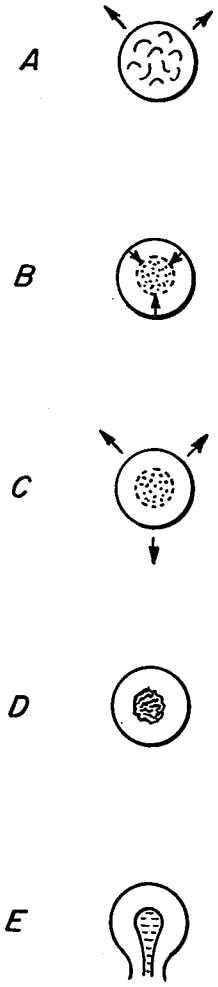
FIG. 2 is a schematic representation of the condition of a single agglomerate throughout the stages of the process of the present invention.

The invention is also illustrated relative to a single agglomerate in FIG. 2, which illustrates schematically the stages of reaction in the process, as hypothesized through present knowledge and belief. In FIG. 2, Stage "A" represents a pellet of iron oxide and carbonaceous material as fed to the preheating zone in the present process, with the arrows showing loss of moisture and volatile materials. In Stages "B", "C" and "D", the pellet is illustrated as it would appear in the reduction zone, with the development of reduction of metal oxide being effected. In Stage "B" the reduction is initiated by application of heat to the pellet, with reduction initially effected at the surface of the pellet and with migration of iron (Fe) ions toward the center of the pellets as shown by the inwardly directed arrows. As reduction proceeds, the iron is amassed at the center portion of the pellet, and carbon monoxide and carbon dioxide gases are discharged from the pellet, being formed during the reduction, as indicated by the outwardly directed arrows in Stage "C". In Stage "D" a pellet is illustrated at the final stage of the reduction zone wherein a molten metallic core is illustrated, the molten core being enveloped within a protective incrustation of slag-like material. In the melting zone, the inert incrustation reaches fusion temperature to permit the molten metal to exude from the pellet, Stage "E", with the molten metal and the resultant slag material then collected and discharged.

It is critical to the process that, when Stage "E" is reached, the molten metal be protected with a controlled atmosphere. Throughout stages "A–D", the atmosphere need not be reducing as the iron is protected from oxidation by the inert incrustation and by discharge of carbon monoxide and dioxide which forms a protective atmosphere. Because the pellets contain sufficient carbonaceous material to effect reduction, no external reducing agents are required.

In Stage "E", as the slag shell reaches its fusion temperature and loses its ability to protect and contain the metal core, the metal will be subject to reoxidation and the atmosphere to which the metal is exposed must be controlled to suit the desired final product. The major elements normally found with reduced iron are silicon, manganese, and carbon and they will oxidize from the molten metal in the order given before the iron itself will be oxidized. The extent of oxidation is dependent upon the oxidizing ability of the atmosphere, temperature, and the time exposed to the atmosphere. At one atmosphere and at the temperature found in Stage E (above 2400°F.), a neutral atmosphere is about 80% carbon monoxide and 20% carbon dioxide. If no oxidation is desired of any of the elements, as in the case of foundry iron, the atmosphere must be controlled in the reducing or neutral range. However, if oxidation is desired to produce an iron low in silicon, manganese, and carbon, the atmosphere must be on the oxidizing side. By controlling the oxidizing ability of the atmosphere and the time of exposure to such atmosphere, the chemistry of the final product can be controlled.

Figure 3:
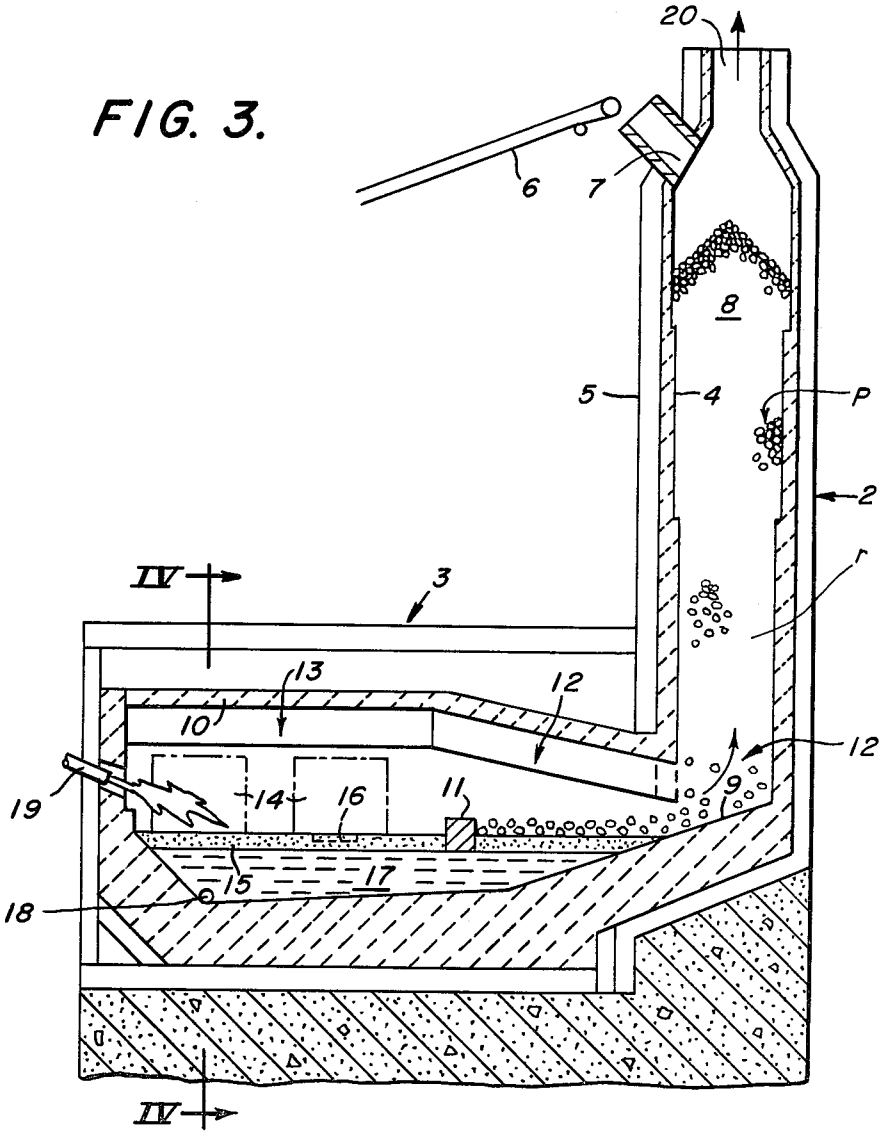
FIG. 3 is a schematic illustration of an apparatus usable in the process of the present invention.
Figure 4:
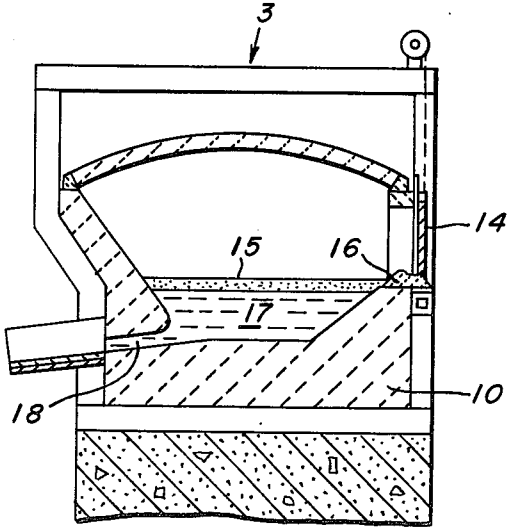
FIG. 4 is a cross-sectional view of the apparatus of FIG. 3 taken along the line IV—IV thereof.

In FIG. 3, there is schematically illustrated an apparatus usable in performing the present process, and the process may be further explained by reference thereto. As illustrated, a shaft furnace 2 and an associated melting vessel 3 are provided, the shaft furnace having a refractory lining 4 and outer shell 5. At the upper portion of shaft furnace 2 there is positioned a charging or feeding means such as a conveyor 6, which charges metal oxide-carbonaceous pellets through inlet 7. The pellets are charged to the shaft furnace 2 and form a column of pellets 8, which column or charge passes downwardly within the shaft furnace and rests upon the bottom 9 of the shaft. The bottom 9 is constructed so as to be inclined at an angle away from the shaft at an angle greater than the angle of repose of the pellets used, such that the pellets will roll from the shaft bottom 9 to the associated melting vessel 3. Melting vessel 3 comprises generally a vessel having a refractory lining 10 and a refractory retarding dam 11 which prevents the pellets from floating with the slag to flush hole 16. The dam 11 also separates the vessel into a zone of controlled atmosphere 12 and a final heating zone 13. The controlled atmosphere zone 12 is provided and controlled by burning a fuel with oxygen through a burner 19. Doors 14 are provided in the melting vessel for control of the slag 15 and a slag flush 16 is also provided. The molten metal 17 is drawn off through a tap hole 18. Near the end of the melting vessel 3 spaced from shaft bottom 9, there is provided a burner 19, such as an oxygen-fuel burner, which is adapted to operate with a controlled atmosphere flame.

In operation, pellets containing metal oxide and carbonaceous material are charged to the shaft furnace by charging means 6 through inlet 7 and a column 8 of pellets formed. The pellets fill the shaft throughout the reducing zone *r* and the preheating zone P of the shaft, and rest upon shaft bottom 9. Oxygen fuel burner 19 is activated and the hot combustion gases thereof are directed through the reducing zone *r* and upwardly through the preheating zone P of the shaft furnace 2. The temperature control of the pellet column is critical to the extent that the pellets resting upon bottom 9 of the shaft and in the reducing zone *r* must be highly heated but the temperature thereof maintained below 2400°F. These hot gases are then passed through the shaft furnace 2 to the preheating zone P and are finally discharged from the shaft furnace 2 through outlet 20. The pellets upon charging to the preheating zone P are heated by the countercurrent gases. The reduction of the iron oxide in the pellets is initiated by the carbonaceous material intimately mixed therewith with formation of reaction gases having a high $CO_2/CO$ ratio composition, these reaction gases being discharged from the pellets. As the temperature of the pellets is increased, the evolution of $CO_2/CO$ reaction gases will decrease and, when the descending pellets reach the reduction zone *r*, the gases leaving the pellets comprises substantially all CO, at which stage reduction of the iron oxide is substantially complete with the pellets comprising a metallic core encased within a slag-type shell.

It is critical at this stage in the process, the stage of molten metal core-slag type shell, that the temperature of the pellets be maintained at a temperature below about 2400°F., so that the pellets maintain their integrity and do not crush or fuse to each other. If the temperature is increased to the point where the slag-type shell loses its integrity, the iron cores of adjacent pellets will weld together and bridge the shaft. Once bridging is effected, the iron upon exposure to an oxidizing condition will reoxidize, and in the process create a further bridging condition above those causing the initial trouble.

As an example of the present process, the following tests were performed. Pellets were formed containing 25.65% iron ore fines, 6.08% blast furnace dust, 13.30% blast furnace sludge, 28.50% mill scale, 9.22%

BOF dust, 12.26% coke breeze and 5% Portland cement as binder. The iron content of the pellets was 51.46%, in the form of oxides of iron. The pellets also contained 5.65% calcium oxide, 0.78% magnesium oxide, 4.62% silicon dioxide, 1.32% aluminum oxide, 0.21% sulfur, 0.07% phosphorus and 14.26% solid carbonaceous material. A quantity of the pellets were charged to a shaft furnace having an integral reverberatory melting unit adjacent the lower end of the shaft. The pellets were heated in the shaft from ambient to about 2400°F. by hot gases from a propane-oxygen flame operating a substantially perfect combustion (producing 100% $CO_2$) during a period of between 18–22 minutes, the pellets maintaining their integrity within the shaft. The pellets were then further heated in the reverberatory furnace during about 5 minutes at about 2400°–3400°F. wherein the pellets melted to release molten iron and slag. The resultant iron contained about 0.018 –0.022% carbon and negligible amounts of manganese and silicon.

A further test using the above pellets and process parameters produced an iron containing about 0.022–0.030% carbon and negligible amounts of manganese and silicon.

Further tests were made using pellets containing 85% iron ore fines and 15% anthracite which following the above procedure produced an iron containing 0.041–0.043% carbon and negligible amounts of manganese and silicon.

Tests using pellets containing 83% iron ore fines, 12% coke breeze and 5% lime produced iron containing 0.033–0.035% carbon and negligible amounts of manganese and silicon.

Figure 5:
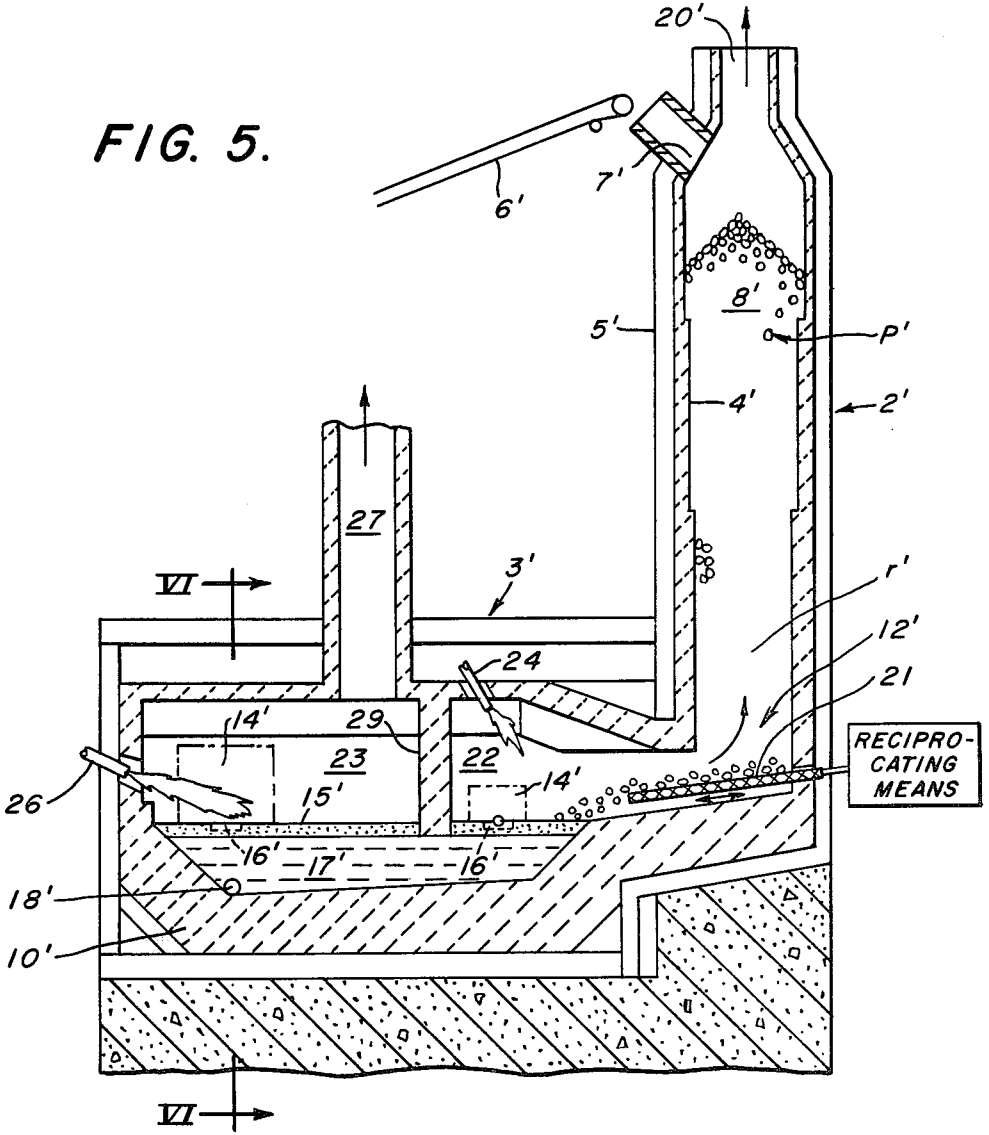
FIG. 5 is a schematic illustration of an alternate apparatus usable in the process of the present invention.
Figure 6:
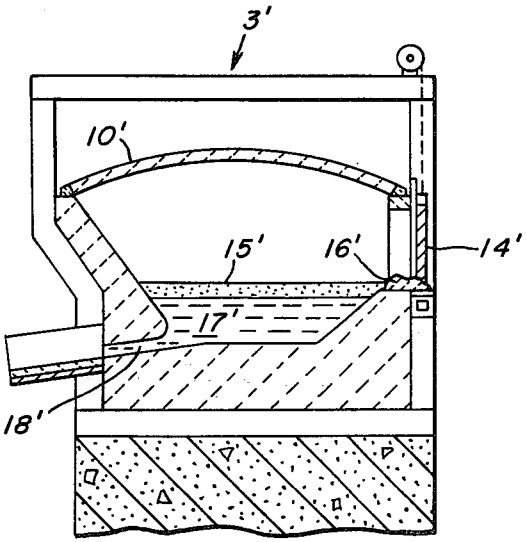
FIG. 6 is a cross-sectional view of the apparatus of FIG. 5 taken along the line VI—VI thereof.

In FIG. 5, there is illustrated a further embodiment of an apparatus for use in the present invention. As therein shown, a shaft furnace 2' is illustrated similar to that described in FIG. 1, with a mechanical feeding means, such as a reciprocating grate 21 shown for use in charging the pellets to the melting zone of the system. In the melting vessel 3', the reverberatory furnace is separated into a two-zone reverberating vessel having a controlled atmosphere zone 22 and a final zone 23. The controlled atmosphere zone 22 has an oxygen-fuel burner 24 for heating, which burner is oxygen starved to the extent desired to control the atmosphere in zone 22. A dividing wall 29 separates the two zones of the reverberating furnace and provides for two combustion zones, while allowing slag and molten metal to flow to the final zone 23. A fuel burner 26, burning to complete combustion, is provided in final zone 23, with burned gases containing oxidants being withdrawn through an outlet 27 in said zone. Tapping and slagging are effected as hereinbefore described.

It is important in the process to transfer the integral reduced pellets from the shaft into the controlled atmosphere melting zone. FIG. 3 shows a method of transfer of pellets by using the angle of repose of the pellet pile to roll pellets into the melting furnace. If the pellets have been heated beyond the point where their integrity is maintained, the pellets may not roll into the furnace and a mixture of slag and wustite will build up at the bottom of the shaft. Also, if the agglomerate is a briquette or other non-spherical shape, difficulty in transferring is also encountered. This difficulty can be overcome by using a mechanical feeder type apparatus in the bottom of the shaft. The most desirable feeder is a slow moving vibrating grate which advances the material toward the melting furnace and retracts slowly allowing the weight of the material in the shaft to force the material to stay in place. This can be effected, as illustrated in FIG. 5, by use of a reciprocating grate or other mechanical feed means.

The illustrated apparatus shows use of a reverberating furnace for melting of the reduced pellets, but it should be pointed out that any vessel wherein a controlled atmosphere may be maintained and wherein the requisite high temperatures may be effected will suffice. For example, an electric arc or induction furnace may be used as the melting zone in the present process.

I claim:

1. A process for the direct reduction of iron oxides comprising:

charging agglomerates of intimately mixed iron oxide, solid carbonaceous material and slag forming material into a shaft furnace, said agglomerates containing sufficient solid carbonaceous material to completely reduce said iron oxide, and raising the temperature of said agglomerates such that the iron oxide therein is reduced to metal by said carbonaceous material, which metal is encased within a slag protective shell formed by said slag forming material, but below the temperature at which said slag forming material liquifies to form integral reduced agglomerates of slag-encased metal;

further heating said integral reduced agglomerates under a controlled atmosphere, said atmosphere being controlled by varying the oxygen supplied to an oxygen-fuel flame, to the fusion temperature of the slag protective shell whereby metal and slag disperse and can be separated; and separating said metal and slag while controlling the cabon content of said metal below saturation by contact with said controlled atmosphere.

2. The process for the direct reduction of iron oxides as defined in claim 1 wherein exhaust gases formed in said shaft furnace are exhausted therefrom and wherein oxygen is introduced to said gases for burning of said gases.

3. The process for the direct reduction of iron oxides as defined in claim 1 wherein said further heating of said integral reduced agglomerates under a controlled atmosphere is carried out in an electric furnace.

4. The process for the direct reduction of iron oxides as defined in claim 1 wherein said further heating is carried out in a melting unit integral with the lower portion of said shaft furnace and wherein said lower portion is so constructed that said integral reduced agglomerates will roll by gravity into said melting unit.

5. The process for the direct reduction of iron oxides as defined in claim 4 wherein a retarding dam is provided within said melting unit to retard rolling of agglomerates into said melting zone until sufficient agglomerates have melted to provide a continuous feed to said melting zone.

6. The process for the direct reduction of iron oxides as defined in claim 4 wherein a two-zone melting vessel is provided with a first zone adjacent the lower portion of the shaft furnace provided with said controlled atmosphere and a second zone adjacent said first zone provided with an oxidizing atmosphere to provide additional heating.

7. The process for the direct reduction of iron oxides as defined in claim 1 wherein said further heating is carried out in a melting unit integral with the lower portion of said shaft furnace and wherein said agglomerates are mechanically fed from said shaft furnace to said melting unit.

8. Process for the direct reduction of iron oxides comprising:

charging agglomerates of iron oxide and carbonaceous material, said agglomerates containing sufficient carbonaceous material to completely reduce said metal oxide, to a shaft furnace having a preheating zone and an underlying reducing zone, the charge being made to the preheaing zone thereof;

passing said charge downwardly within said shaft furnace to the reducing zone thereof wherein said agglomerates are heated by a countercurrent flow of hot gases to an elevated temperature below about 2400°F. at which iron oxide therein is reduced by said carbonaceous material while maintaining the integrity of said agglomerates;

transferring said reduced agglomerates while at said elevated temperature from said shaft furnace to a melting vessel wherein the agglomerates are heated further to a temperature in excess of 2400°F. at which the metal produced by the reduction becomes molten and the agglomerates melt to release said molten metal, the atmosphere within the melting vessel being controlled to regulate the carbon content of said molten metal, the agglomerates forming a mass of molten metal and slag; and discharging from the melting vessel said molten metal and said slag.

9. The process for direct reduction of iron oxides as defined in claim 8 wherein said iron oxide contains at least one steel plant waste material selected from iron oxide fines, blast furnace dust, open hearth dust, electric furnace dust and mill scale.

10. The process for direct reduction of iron oxides as defined in claim 8 wherein said carbonaceous material is selected from coke, finely divided coal, petroleum coke and coke breeze.

11. The process for the direct reduction of iron oxides as defined in claim 8 wherein the particle size of the iron oxide and the carbonaceous material in said agglomerates is such that at least about 50% of the particles pass through a 200 mesh screen while substantially all particles will pass through a 30 mesh screen.

12. Process for the direct reduction of iron oxides comprising:

charging pellets of iron oxide contained in at least one steel plant waste material selected from iron ore fines, blast furnace dust, open hearth dust, electric furance dust and mill scale, and carbonaceous material selected from coke, finely divided coal, petroleum coke and coke breeze, said agglomerates containing sufficient carbonaceous material to completely reduce said iron oxide, to a shaft furnace having a preheating zone and an underlying reducing zone, the charge being made to the preheating zone thereof;

passing said charge downwardly within said shaft furnace to the reducing zone thereof wherein said pellets are heated by a countercurrent flow of hot gases to an elevated temperature below about 2400°F. at which iron oxide therein is reduced by said carbonaceous material while maintaining the integrity of said pellets;

transferring said reduced pellets while at said elevated temperatures from said shaft furnace to a melting vessel wherein the pellets are heated further to a temperature in excess of 2400°F. at which the iron produced by the reduction becomes molten and the pellets melt to release said molten iron, the atmosphere within the melting vessel being controlled to regulate the carbon content of said molten iron, the pellets forming a mass of molten iron and slag; and discharging from the melting vessel said molten iron and said slag.

* * * * *